US007055368B2

(12) United States Patent
Schneider et al.

(10) Patent No.: US 7,055,368 B2
(45) Date of Patent: Jun. 6, 2006

(54) AUTOMATIC CALIBRATION OF AN IMBALANCE DETECTOR

(75) Inventors: Harvey Schneider, Southbury, CT (US); David M. Carson, Newtown, CT (US)

(73) Assignee: Kendro Laboratory Products, Inc., Newton, CT (US)

( * ) Notice: Subject to any disclaimer, the term of this patent is extended or adjusted under 35 U.S.C. 154(b) by 159 days.

(21) Appl. No.: 10/441,285

(22) Filed: May 20, 2003
(Under 37 CFR 1.47)

(65) Prior Publication Data

US 2004/0055361 A1 Mar. 25, 2004

Related U.S. Application Data

(60) Provisional application No. 60/381,811, filed on May 21, 2002.

(51) Int. Cl.
*B04B 9/14* (2006.01)
*B04B 13/00* (2006.01)

(52) U.S. Cl. ..... 73/1.87; 494/10; 702/105

(58) Field of Classification Search ..... 73/1.87, 73/462; 702/105; 494/10; 700/279
See application file for complete search history.

(56) References Cited

U.S. PATENT DOCUMENTS 5,421,199 A * 6/1995 Himmler ..... 73/462
5,496,254 A * 3/1996 Keller et al. ..... 494/10 X
5,579,071 A * 11/1996 Wetzel et al. ..... 396/428
5,583,483 A * 12/1996 Baumann ..... 340/444
5,627,762 A * 5/1997 Cameron et al. ..... 700/279
5,659,136 A * 8/1997 Koch et al. ..... 73/462
5,685,038 A * 11/1997 Smith et al. ..... 8/159
5,805,464 A * 9/1998 Cameron et al. ..... 700/279
5,893,279 A * 4/1999 Schantz et al. ..... 68/12.06

FOREIGN PATENT DOCUMENTS

JP 2002316072 A * 10/2002

* cited by examiner

*Primary Examiner*—Thomas P. Noland
(74) *Attorney, Agent, or Firm*—Baker & Hostetler LLP

(57) ABSTRACT

Methods and apparatus for a centrifuge control system, which are particularly suited for automatically calibrating a centrifuge imbalance detector that include an accelerometer and a controller. The controller is configured to automatically calibrate imbalance limits. Upon determining these limits, the controller assigns these limits or values to the accelerometer.

10 Claims, 3 Drawing Sheets

AUTOMATIC CALIBRATION OF AN IMBALANCE DETECTOR

PRIORITY

This application claims priority to the provisional U.S. patent application entitled AUTOMATIC CALIBRATION OF AN IMBALANCE DETECTOR, filed May 21, 2002, having a Ser. No. 60/381,811, the disclosure of which is hereby incorporated by reference.

FIELD OF THE INVENTION

The present invention relates generally to centrifuge imbalance controls. More particularly, the present invention relates to an automated calibration of an imbalance detector in a centrifuge system.

BACKGROUND OF THE INVENTION

A centrifuge instrument is a device by which liquid samples may be subjected to centrifugal forces. The sample is carried within a member known as a centrifuge rotor. The rotor is mounted to a rotatable drive shaft that is connected to a source of motive energy.

Centrifuges currently employed in laboratories are generally operated by manual controls using various settings and procedures. A rotor control may be used to set the centrifuge to a specific size or type of rotor. A temperature control and timer are also frequently used depending on the type of sample being tested. There are conventional power switches to manually turn the units on or off as needed. A physical key lock is commonly used to secure centrifuge access from operation. Screwdriver adjusted sensors or trimmers are traditionally used to correct the setting of an imbalance detector. This adjustment is exceedingly time consuming and inaccurate.

Centrifuge operation presents a unique set of design criteria where precision control of the rotational operation of the centrifuge is required. The wide variety of biological and chemical experimental research which use centrifugation as their primary tool to achieve component separation and perform experimental assays places a requirement of versatility on the operational characteristics which must be built into the centrifuge.

The centrifuge rotor is driven to extremely high rotational speeds in order to generate the centrifugal field required for biological research use. The high rotational speed requires the samples that are placed in the centrifuge rotor to be equally loaded or balanced to a pre-determined level. If this is not done or a sample bottle breaks or leaks at speed a large imbalance will result. Large imbalances at high speed are very destructive to the centrifuge drive and suspension system, and in severe cases cause unwanted centrifuge movement. Centrifuge systems are routinely designed with imbalance detectors to shut down the run in severe imbalance conditions.

The centrifuge apparatus has numerous rotors which may be interchangeably used in conjunction with the same centrifuge motor and drive shaft in order that a diversity of biological experimentation may be achieved. One standard of centrifuge design encompasses a motor with a flexible shaft which can accommodate the interchangeable rotors to be carried on the spindle of the motor shaft, each rotor having a different weight and strength of material and a different maximum safe speed above which the particular rotor should not be operated. Some centrifuge systems will use a flexibly mounted drive shaft coupled to the motor, commonly called a gyro system. This performs the same function as the motor with a flexible shaft, but is more damage tolerant.

Also, an imbalance of the rotor or load which it carries will increase in force as the rotor speed increases, the increase in force will be proportional to the square of the increase in speed. Often, these imbalances do not arise until the rotor has achieved very high speeds, normally through sample tube leakage or breakage. The dynamic effect of large unbalancing forces cause complicated movement of the shaft, or gyro, upon which the rotor is suspended, such as dangerous whirls and gyrations.

The rotor is part of a centrifuge system that includes a motor or other source of motive energy, a drive shaft or gyro system, and a rotor mounting device disposed at the upper end of the drive shaft or gyro shaft, on which the rotor is received. Like other mechanical devices or bodies that rotate at a high speed, the rotor has certain modes of vibration which become apparent when the rotor is accelerated through its speed range. The rotor normally rotates about its geometric center of gravity. At critical speed the rotor shifts its axis of rotation laterally from that of the rotors geometric center to that of the rotors center of mass. During normal use, the rotor generally passes through its critical speed when accelerating from a stopped position to its operating speed, and after centrifugation is completed, when decelerating from its operating speed to a stopped position. Although the rotational energy of the system is low relative to the energy at much higher operating speeds, it is at this lower, so called "critical speed" of rotation that imbalances in the rotor introduce gross loading errors which tend to cause large rotor movements.

Typically, therefore, the centrifuge's drive system mount design including the shaft stiffness or gyro is provided with some form of compliance mechanism which accommodates the forces generated by the system as the rotor's rotation approaches and traverses its critical speed. This system compliance is also designed to operate at high speeds when the system accelerations are at a maximum.

When an operator is loading a centrifuge rotor, an important objective is achieving a weight-balanced, symmetrical sample distribution pattern about the drive shaft and instructions are normally provided to reach this objective. However even the most careful operator will still make errors in loading and sample container leakage and breakage will unexpectedly occur, so the system must be designed to detect when vibration levels are excessive and shut down the centrifuge before damage can occur. If not reduced or sufficiently dampened, the total unbalancing forces, arising from inherent rotor imbalances and/or sample loading patterns may result in premature failure of the centrifuge.

It is therefore clear that a versatile centrifugation system requires: (1) a maximum safe rotor speed be identified for each rotor; (2) the operational use and control of the rotor during centrifugation be monitored and controlled; and, (3) that any imbalance be detected. If possible, the use of a single sensor or transducer system would provide accuracy and asynchronous information which may be used to limit imbalance forces for all varieties of rotors at different speeds.

In laboratory centrifuges, the rotor, i.e., the part of the structure which rotates and which carries a vessel with material to be subjected to centrifugal force, is balanced at the time of manufacture. Nevertheless, in the event of a defect or of uneven loading of the vessel, an imbalance may arise that can be tolerated only within specific limits. Otherwise, damage may occur when operating the centrifuge, especially at high speeds.

Accordingly, centrifuges of this kind are equipped with shutoff devices for turning the motor off when an upper threshold imbalance, empirically ascertained for the particular centrifuge, is exceeded. However, ascertaining the imbalance arising at centrifuge startup entails difficulties.

The state of the art comprises high cost shutoff devices which typically operate using magnetic-field detectors to monitor the rotor-generated magnetic fields and to thereby determine the imbalance.

Known centrifuges have been marketed for many years in which a mechanical switch is mounted on the housing and, upon rotor imbalance and lateral deviation, the switch makes contact with an element mounted on the stator which then actuates the shutoff switch. This design, however, incurs two substantive drawbacks. On one hand, mechanical switches may fail per se and on the other hand the switch or the element on the drive system must be adjusted to assure that switching off takes place accurately at the specific threshold imbalance. Assembly costs are raised as a result. Furthermore, the deviation depends on support tolerances and therefore will differ among units of the same type at the same imbalance.

The present invention overcomes the prior art problems by utilizing an automated centrifuge imbalance detector process and control system.

SUMMARY OF THE INVENTION

The foregoing needs are met, to a great extent, by the present invention, wherein in one aspect an apparatus is provided that in some embodiments utilizing an automated centrifuge imbalance detector method and apparatus.

In accordance with one aspect of the present invention, an imbalance calibration control system is provided comprising a centrifuge, an imbalance detector and a controller, wherein the controller automatically calibrates imbalance limits of the centrifuge and assigns these limits to the imbalance detector.

In accordance with another aspect of the present invention, a method of calibrating an imbalance detector is provided comprising the steps of placing a known imbalance within a centrifuge, running the centrifuge at a set speed, capturing run data for analysis, and saving said run data to a controller.

In accordance with yet another aspect of the present invention, an imbalance calibration device is provided comprising means for placing a known imbalance within a centrifuge, means for running the centrifuge to a set speed, means for capturing run data for analysis, and means for saving said run data to a controller.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DESCRIPTION OF THE INVENTION

Figure 1:
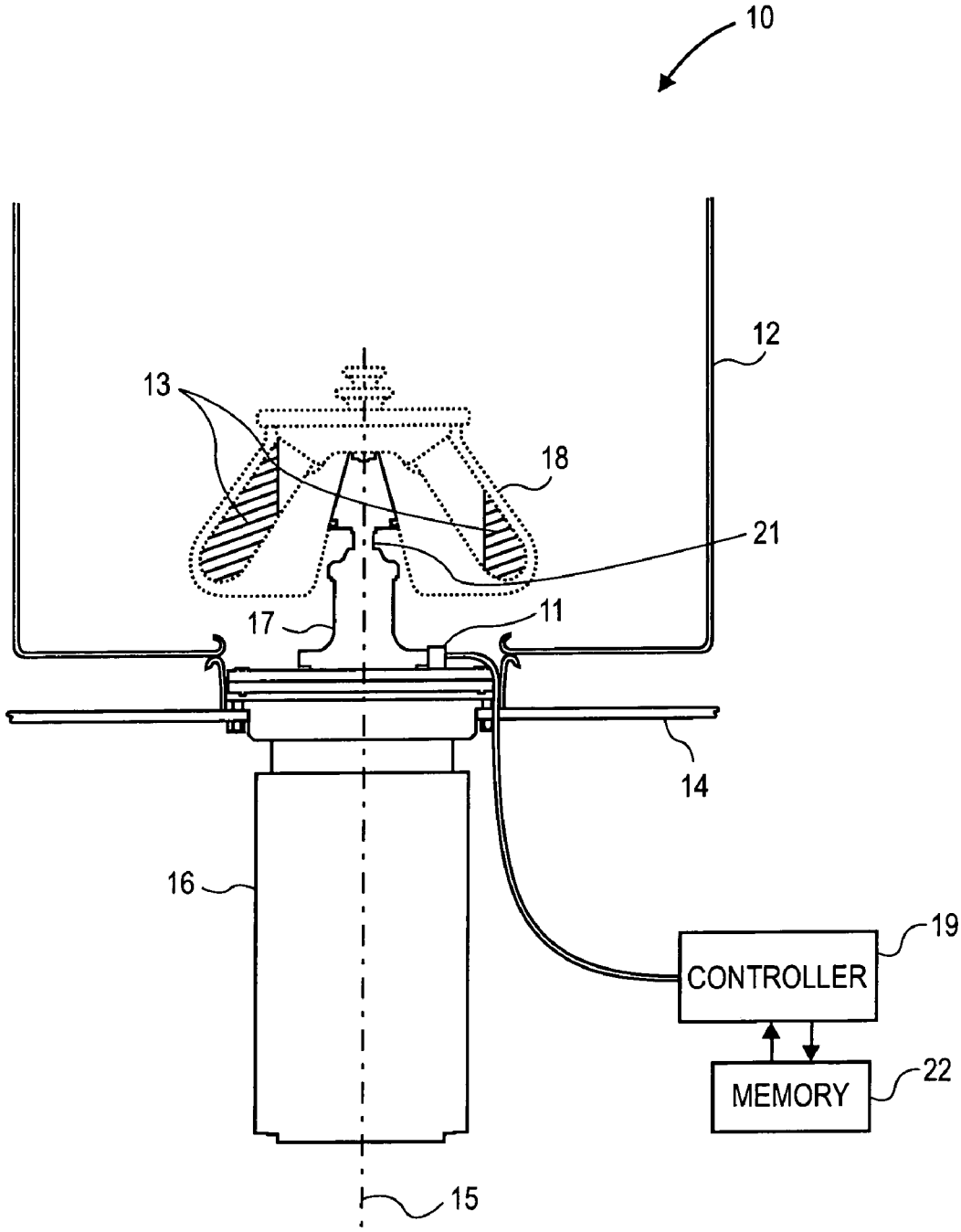
FIG. 1 shows cross-section of one preferred embodiment of the present invention showing the centrifuge controller and imbalance detector.

The invention will now be described with reference to the drawing figures, in which like reference numerals refer to like parts throughout.

Referring to FIG. 1, a preferred embodiment of the invention provides an automated apparatus and method of calibrating an imbalance detector. A centrifuge system 10 is provided comprising an imbalance detector 11 which preferably is an accelerometer or any other compatible sensory device, an evaporator 12, a rotor 18 with a known imbalance 13 contained therein, a centrifuge frame 14, a motor 16, a gyro 17, and a controller 19 having memory 22. A known imbalance 13 is placed inside a rotor 18 which is then run to a predetermined speed by motor 16 in communication with gyro 17 and motor drive shaft 21.

Figure 2:
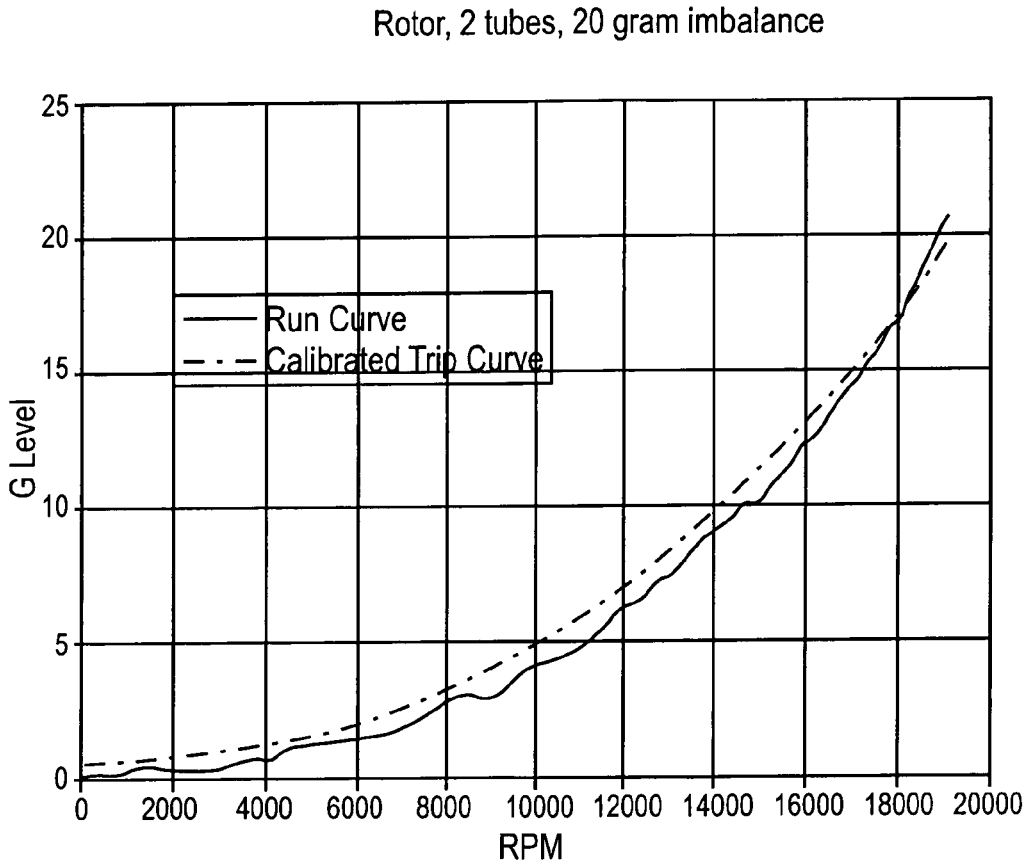
FIG. 2 shows the gravity levels or acceleration levels vs. revolutions per minute curve of a rotor of one preferred embodiment of the present invention.

Referring to FIG. 2, the G-level (from the accelerometer) vs. RPM curve produced by this run is used to determine the mathematical coefficients for an equation that describes the acceptable imbalance limits. The zero offset for this equation is then set. This zero offset minimizes the errors that would occur due to time or due to any thermal drift of the components and low speed errors. The centrifuge controller does the data collection. The centrifuge controller then uses the data collected to compute the mathematical coefficients for an equation that describes the acceptable imbalance limits, and computation of the zero offset. All runs are then compared against this equation for imbalance conditions. The entire process is software automated by a controller 19 for calibration with the user only being required to place the correct imbalance into the rotor 18.

Referring back to FIG. 1, as the rotor 18 is spun with the known imbalance the imbalance detector 11 is subjected to an up and down vertical motion or side to side horizontal motion depending on the mounting of the imbalance detector 11. This is due to the mass shift of the centrifuge rotor 18 caused by the imbalance which results in precession or whirling about the geometric axis 15 which is shared by the gyro 17, the motor 16 and the motor drive shaft 21. For example, as the rotor speed is increased the rapidity of the change in the vertical direction will increase, this change in direction and the frequency of the change results in the acceleration which is measured by the imbalance detector

11. The acceleration is dependent on two factors the amount of the imbalance and the rotational speed of the rotor 18.

There is a limit on the amount of imbalance that the centrifuge 10 can be subjected to. If the imbalance is to high, mechanical damage to the centrifuge will result. The engineer through analysis and experimentation determines the amount of this imbalance.

The imbalance detector 11 monitors the amount of acceleration caused by the imbalance over the entire speed range of the run. If it exceeds the imbalance profile at any point the run is terminated.

There are a number of variables that have to be taken into account which would affect the output of the imbalance detector 11, mounting position, component spring rate, component damping rate, frame affect and manufacturing variability of the imbalance detector 11. These factors are normally addressed through precision mounting, testing and manufacturing. The present invention addresses all of these variables and concerns by mounting the imbalance detector 11 on a centrifuge system 10 with a rotor 18 containing a known imbalance 13 and using the system to calibrate and determine the amount of allowable imbalance at any speed.

Figure 3:
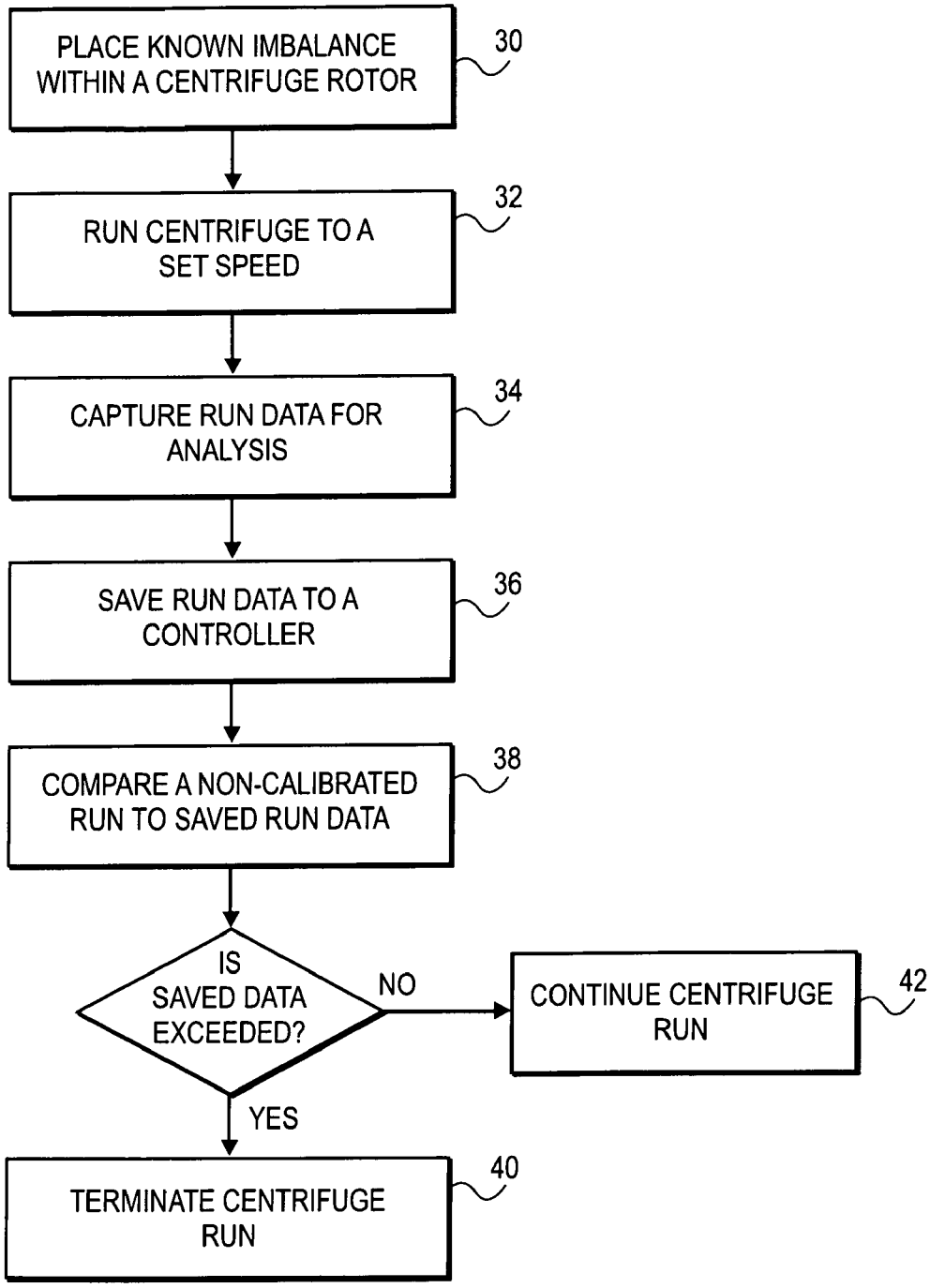
FIG. 3 shows a flowchart of the process of one preferred embodiment of the present invention.

Referring to FIGS. 2 and 3, in operation, the known imbalance 13 is placed 30 in the rotor 18 and the rotor 18 is run to a set speed 32. During this run the data from the imbalance detector 11 is captured 34 by the controller 19 and stored 36.

This data is saved 36 in the controller memory 22 and used to compare 38 against on all subsequent runs. If the imbalance detector 11 output during a non-calibration run exceeds the saved data from the calibration run, the run is terminated 40 otherwise the run shall proceed 42. For example, in FIG. 2 the run would be terminated at approximately 18,000 rpm when the run curve crosses the calibrated trip curve.

The many features and advantages of the invention are apparent from the detailed specification, and thus, it is intended by the appended claims to cover all such features and advantages of the invention which fall within the true spirits and cope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An imbalance calibration control system, comprising a centrifuge;

an accelerometer acting as an imbalance detector;

a controller that automatically calibrates imbalance limits of the centrifuge and assigns these limits to the imbalance detector; and a rotor connected to a gyro in communication with a motor drive shaft.

2. The system of claim 1, wherein said imbalance detector is connected to said controller.

3. The system of claim 1, wherein said rotor, said gyro and said motor drive shaft share a common geometric axis.

4. The system of claim 3, wherein said accelerometer is in communication with one of a group consisting of said gyro and said motor drive shaft.

5. The system of claim 4, wherein said accelerometer is disposed to move in a plane relative to said geometric axis.

6. The system of claim 1, wherein said controller has memory storage.

7. An imbalance calibration apparatus, comprising a centrifuge;

a centrifuge rotor mounted within said centrifuge;

an accelerometer in communication with said rotor and acting as an imbalance detector;

a controller that automatically calibrates said imbalance detector and assigns limits to said imbalance detector; and a gyro in communication with a motor drive shaft.

8. The apparatus of claim 7, wherein said imbalance detector is connected to said controller.

9. The apparatus of claim 7, wherein said rotor, said gyro and said motor drive shaft share a common geometric axis.

10. The apparatus of claim 9, wherein said accelerometer is disposed to move in a plane relative to said geometric axis.

* * * * *